United States Patent [19]

Jokinen

[11] 4,165,005

[45] Aug. 21, 1979

[54] METHOD AND APPARATUS FOR THE INSTALLATION OF THE SUPPORT ELEMENT OF A CRANE

[75] Inventor: Olli Jokinen, Tampere, Finland

[73] Assignee: Rauma-Repola Oy, Tampere, Finland

[21] Appl. No.: 792,999

[22] Filed: May 2, 1977

[30] Foreign Application Priority Data

May 6, 1976 [FI] Finland ..... 761269

[51] Int. Cl.[2] ..... B66C 23/62

[52] U.S. Cl. ..... 212/145; 280/763

[58] Field of Search ..... 212/1, 58 R, 59 R, 48, 212/49, 145; 187/9 E; 280/760, 762, 763

[56] References Cited

U.S. PATENT DOCUMENTS

| | | | |
|---|---|---|---|
| 1,965,367 | 7/1934 | Brown | 212/47 |
| 2,923,418 | 2/1960 | McGuire et al. | 212/55 |
| 3,278,045 | 10/1966 | Potter et al. | 212/49 |
| 3,391,810 | 7/1968 | Tourneau | 212/47 |
| 3,726,416 | 4/1973 | Pottorff et al. | 212/49 |

*Primary Examiner*—Lawrence J. Oresky

*Attorney, Agent, or Firm*—Burns, Doane, Swecker & Mathis

[57] ABSTRACT

A support element is disclosed which is movable vertically with respect to a frame of a wheeled vehicle as a result of extension of one or more extensible members of the support element. The support element is suspended from the frame by at least one suspension member, which is operatively attached to the frame and to at least one of the extensible members.

The at least one suspension member may also be operatively connected to a relatively fixed portion of the support element.

21 Claims, 4 Drawing Figures

METHOD AND APPARATUS FOR THE INSTALLATION OF THE SUPPORT ELEMENT OF A CRANE

Figure 1:
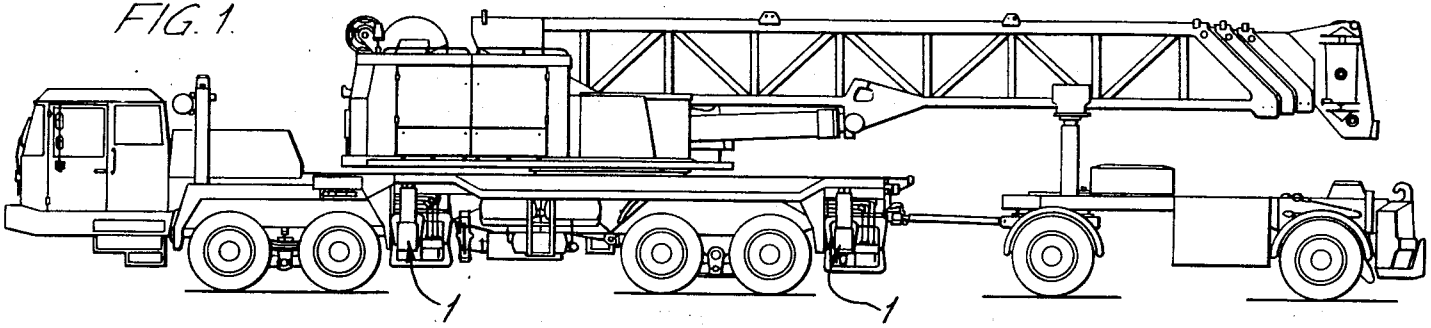

The subject of the present invention is a method and apparatus for raising and lowering a support element for the purpose of removal and fastening of a support element from/to a crane with a wheeled chassis. With the increase in the size of the cranes, the axle or bogie load of cranes with wheeled chassis has become an important limiting factor, because the carrying capacity of roads and especially of road bridges is limited. If the permitted axle or bogie loads are exceeded, exceptional permissions must be applied for for the purpose of moving the crane from one working site to another. Attempts have been made to overcome these difficulties, e.g., by increasing the number of axles of the crane, but additional axles increase the cost of the crane quite extensively as compared with the reduction in the axle or bogie loads. This is especially so if the axles must be made steering axles. Another approach has been to make some components of the crane detachable, in which case, for the road transport, they have been shifted so as to load least loaded axles, or they have been moved to the next working site by another vehicle. Such detachable components can be, for example, the counterweight, the support elements, and the arm system. Removal of the support elements has been quite cumbersome and time-consuming, and it often requires various additional equipment, because the large size of these elements and their location underneath the crane results in the circumstance that the removal of the fastening means, e.g. fulcrum pins, is difficult. The difficulty results when the elements are lifted by means of an external crane or when the operating equipment of the element itself is used, e.g. the hydraulic cylinders, so as to support the elements from the ground in order to make them free from load. The elements are readily twisted into a diagonal position or are loaded unevenly, in which case the support elements cannot be detached without large hammers and crowbars and without the use of abundant force.

In the arrangement in accordance with the invention, gravity is used so that the support elements can be suspended freely without external auxiliary force and so that the support element can be moved manually in the lateral direction and by some actuating means, e.g. by means of the extending cylinder of the support element itself, in the vertical direction, in which case the removal of the fastening means can be accomplished without using high power.

The method and apparatus in accordance with the invention is mainly characterized in that one or more installation elements or suspension members, preferably two installation elements, such as ropes, wires, chains, articulated mechanisms, or equivalent, are arranged between the wheeled-chassis frame of the crane and the support element so that each installation element has at least one support or fastening point, in addition to the operative fastening point to the wheeled-chassis frame of the crane, either in the frame portion of the support element or in the supports devices which are movable by means of cylinder-piston in relation to the frame portion of the support element. Accordingly, said support element can, by making use of the movement given by its own cylinder-piston devices to the installation elements, be suspended on the installation elements from the frame of the crane chassis so that the fastening means proper, such as fulcrum pins, between the support element and the frame of the crane chassis remain unloaded.

Figure 3:
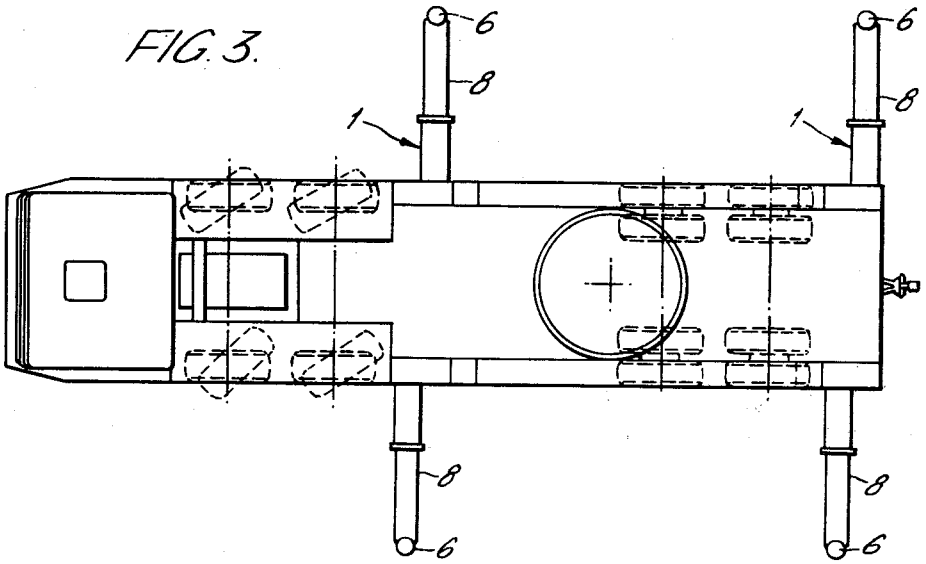
Figure 2:
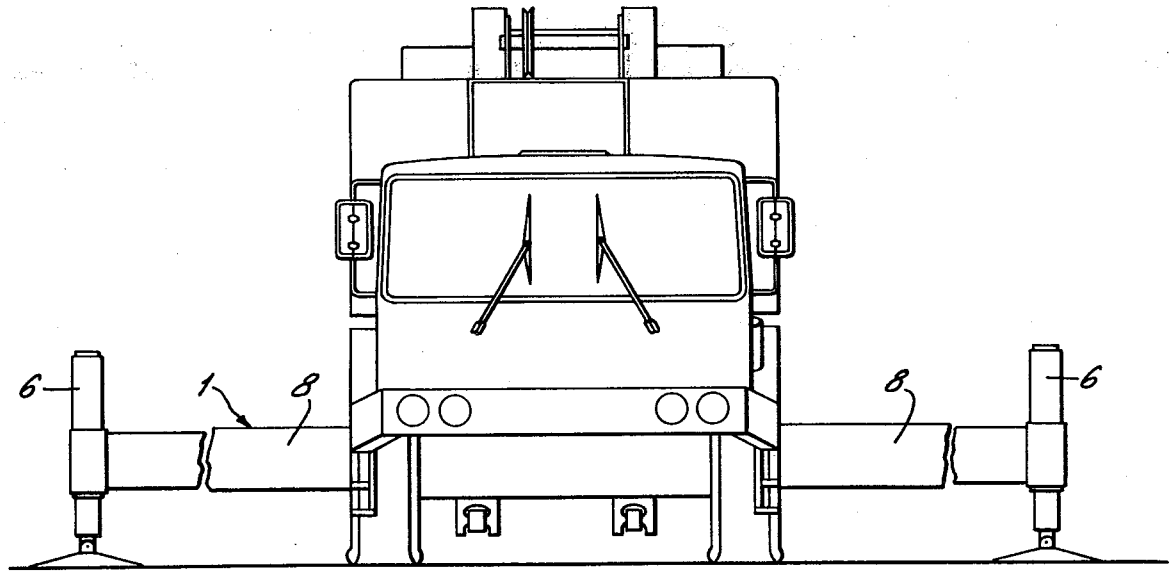
Figure 4:
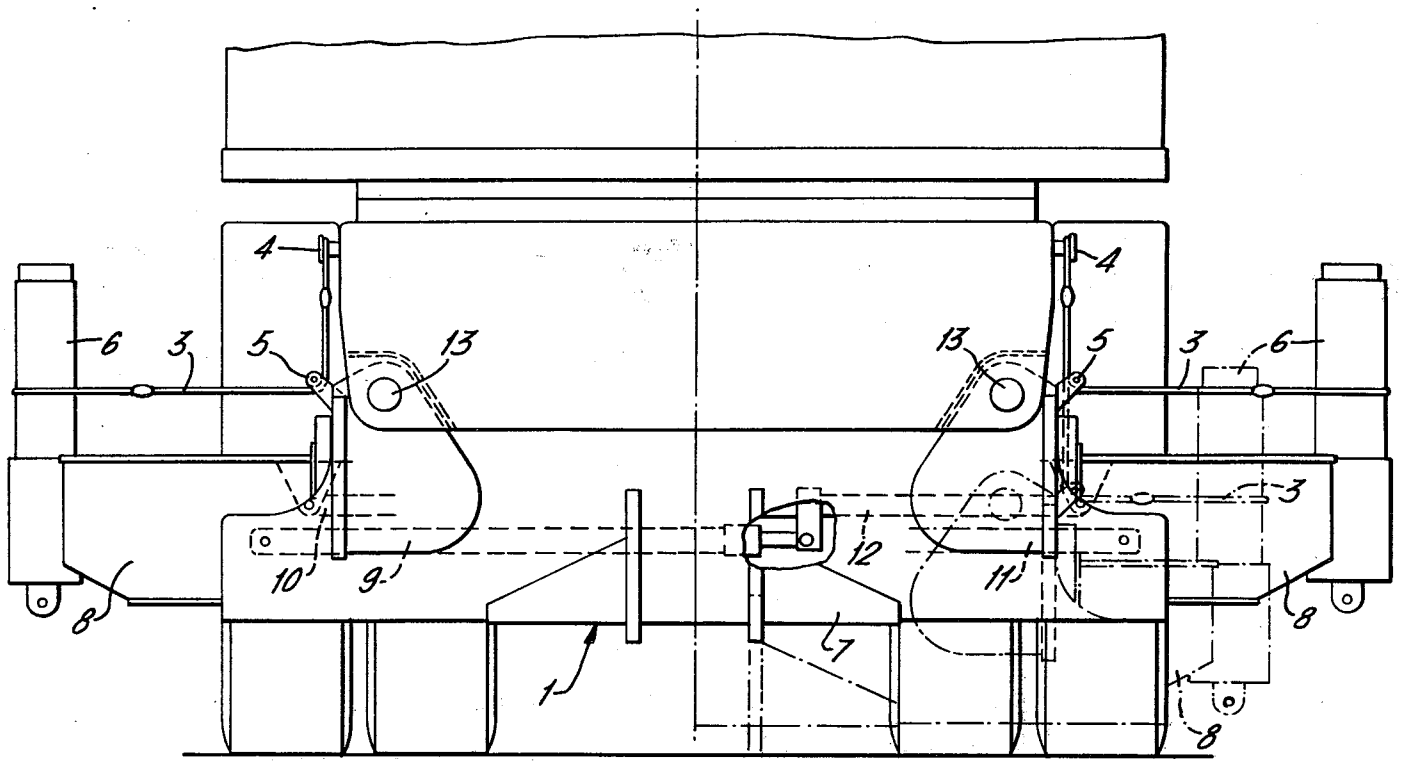

The invention comes out more closely from the following description and from the attached drawings, wherein FIG. 1 is a side view of a crane vehicle combination, FIG. 2 is a front view of the crane vehicle combination of FIG. 1, FIG. 3 is a top view of the crane vehicle combination of FIG. 1, and FIG. 4 shows an arrangement for raising and lowering the support element of the crane for the purpose of removal and fastening of the element.

The arrangement in accordance with the invention can be accomplished, e.g., by means of the construction shown in FIG. 4. Therein pins 4 are fastened on both sides of the frame 2 of the crane chassis, and one end of a rope 3, chain, etc. or equivalent installation means is fastened around the neck of said pin 4. The rope 3 passes over a pulley 5 (or pulleys) or equivalent and is fastened to the "stationary" part 7 of the support element 1. The other end of the rope is fastened to the extensible or mobile part 8 of the support element 1, whereby, by pushing the support 8 out and in, it is possible to move the element 1 in the vertical direction.

The system can also be accomplished so that the pulley 5 is placed in the mobile part 8 of the support and so that the end of the rope 3 is fastened to the stationary part 7 of the support. In another arrangement the pulleys are mounted so that it is possible to use the vertical cylinder 6 of the support element 1 instead of two or more horizontal cylinders 9, 10, 11 and 12 to move the support element. Likewise, the rope 3 or equivalent means can be substituted, e.g., by an articulated mechanism. There may be one or more ropes, and there may be several pulleys 5.

In the exemplifying embodiment in accordance with the invention and shown in FIG. 4, two loop-ended wires 3 are used as installation means, which wires are, as shown in FIG. 4, arranged between the crane chassis and the support element 1 so that one end of the installation means 3 is fastened to the frame 2 of the crane chassis, from which the installation means 3 is guided so as to pass over a pulley 5 fastened to the frame portion 7 of the support element 1, and its other end is fastened to the mobile part 8 of the support element 1 around the cylinder 6. When, by means of the cylinder-piston devices 9, 10, 11, and 12, the supports 8 are pushed towards the side, they also pull with themselves the installation means 3 placed around the cylinders 6, in which case the support element 1 comes to be supported by the installation means 3, i.e. hangs on said means. When the support element is in this way suspended completely freely from the frame 2 of the crane chassis, the fastening means proper, e.g. fulcrum pins 13, remain unloaded and they can be removed easily from their positions.

The invention is of course not restricted to the above exemplifying embodiment alone, but it may show variety in many ways within the scope of the patent claims.

What we claim is:

1. Apparatus for raising and lowering a support element with respect to a wheeled vehicle such as a crane, comprising:

a wheeled vehicle having a frame member;

a vehicle support element having at least one extensible member, and having means for selectively supporting a portion of the weight of said wheeled vehicle;

means for extending the extensible member with respect to the support element;

suspension means for connecting the vehicle support element to the frame member, the suspension means being operatively connected both to the frame member and to the at least one extensible member, whereby extension of the extensible member causes the vehicle support element to move vertically with respect to the frame member, the vehicle support element being suspendable relative to the wheeled vehicle solely by the suspension means; and, fastening means for releasably attaching the vehicle support element to the frame member independently of the suspension means.

2. The apparatus of claim 1, wherein the vehicle support element includes first and second extensible members which are extensible in directions opposite to one another, the suspension means being operatively connected to both extensible members.

3. The apparatus of claim 2, wherein the first and second extensible members are extensible horizontally with respect to the vehicle support element.

4. The apparatus of claim 1, wherein the vehicle support element includes first and second extensible members which are extensible in directions parallel to one another, the suspension means being operatively connected to both extensible members.

5. The apparatus of claim 4 wherein the first and second extensible members are extensible in a vertical direction.

6. The apparatus of claim 1 wherein the suspension means are also operatively connected to the support element.

7. The apparatus of claim 1 wherein the suspension means includes at least one flexible member.

8. The apparatus of claim 7 wherein the flexible member has a fixed length.

9. The apparatus of claim 8 further comprising:

pulley means for supporting the flexible member.

10. The apparatus of claim 9, wherein the pulley means includes at least one pulley secured to the frame member.

11. The apparatus of claim 9, wherein the pulley means includes at least one pulley secured to the support element.

12. The apparatus of claim 9, wherein the pulley means includes at least one pulley secured to the at least one extensible member.

13. The apparatus of claim 1 wherein the suspension means includes at least one rigid member.

14. The apparatus of claim 1 wherein the suspension means includes at least one articulated member.

15. A method of raising and lowering a support element, which is selectively operable to support a portion of the weight of a wheeled vehicle, with respect to said wheeled vehicle such as a crane, comprising the steps of:

fastening said support element to said wheeled vehicle;

operatively connecting at least one suspension member both to a frame member of the wheeled vehicle and to an extensible member of the support element whereby extension of the extensible member relative to the support element results in a vertical movement of the support element relative to the frame;

extending the extensible member relative to the support element to thereby move the support element vertically with respect to the frame;

unfastening said support element from said wheeled vehicle; and, suspending and lowering the support element relative to the frame member of the wheeled vehicle entirely by said at least one suspension member.

16. The method of claim 15 further comprising the step of connecting a first end of the at least one suspension member to the frame member and a second end to the extensible member.

17. The method of claim 16 further comprising the step of:

passing the at least one suspension member at least partially around a pulley secured to the support element.

18. The method of claim 15 further comprising the step of:

operatively connecting a second suspension member to the frame member of the wheeled vehicle and to a second extensible member of the support element whereby a simultaneous extension of both of the extensible members results in a vertical movement of the support element relative to the frame.

19. The method of claim 18 wherein the extensible members are extended vertically in the same direction.

20. The method of claim 18 wherein the extensible members are extended horizontally in opposite directions.

21. The method of claim 15 wherein the support element is unfastened by removing at least one pin.

* * * * *